US005259287A

United States Patent [19]

Sato et al.

[11] Patent Number: 5,259,287

[45] Date of Patent: Nov. 9, 1993

[54] UPRIGHT PIANO EQUIPPED WITH COUPLING UNITS FOR HORIZONTALLY SUPPORTING KEY BED

[75] Inventors: Takane Sato; Hideo Yamashita; Hisao Mori, all of Shizuoka, Japan

[73] Assignee: Yamaha Corporation, Hamamatsu, Japan

[21] Appl. No.: 911,985

[22] Filed: Jul. 10, 1992

[30] Foreign Application Priority Data

Jul. 12, 1991 [JP] Japan ..... 3-198732

[51] Int. Cl.[5] ..... G10C 3/12

[52] U.S. Cl. ..... 84/432

[58] Field of Search ..... 84/423 R, 432, 186.1, 84/434, 435

[56] References Cited

U.S. PATENT DOCUMENTS

| | | | |
|---|---|---|---|
| 217,828 | 7/1879 | Steinway | 84/432 |
| 745,509 | 12/1903 | Müller | 84/432 |
| 4,127,051 | 11/1978 | Conklin, Jr. | 84/423 |

*Primary Examiner*—Michael L. Gellner
*Assistant Examiner*—P. Stanzione
*Attorney, Agent, or Firm*—Spensley Horn Jubas & Lubitz

[57] ABSTRACT

It is important for an upright piano to keep a keyboard on a key bed horizontal, and the key bed is supported by a frame through coupling units, wherein each of the coupling units has a wedged member interposed between a projection of the frame and a bracket of the coupling unit or between the bracket and the key bed for regulating the horizontality of the keyboard.

8 Claims, 4 Drawing Sheets

UPRIGHT PIANO EQUIPPED WITH COUPLING UNITS FOR HORIZONTALLY SUPPORTING KEY BED

FIELD OF THE INVENTION

This invention relates to an upright piano and, more particularly, to a structure of a coupling member between a key bed and a frame incorporated in the upright piano.

DESCRIPTION OF THE RELATED ART

In order to assemble a key bed with a frame, coupling members are provided therebetween, and a typical example of such a coupling member is disclosed in Japanese Utility Model Publication (Kokoku) No. 2-24154. The structure of the frame is briefly described hereinbelow, and word "front" is applied to a surface or an edge closer to a player. The frame is constructed from a plate upright with respect to a plate base, a sound board also upright from a sound board base and ribs. The strings are stretched over the front surface of the plate, and are terminated thereat. The sound board is faced to the back surface of the plate, and is fixed between the plate base and the sound board base. Bridges are provided on the front surface of the sound board, and the strings are tensioned by means of the bridges. The ribs are attached to the back surface of the sound board, and reinforce the sound board.

The prior art coupling members disclosed in the Japanese Utility Model Publication are assembled with a frame with a pair of projections, and the pair of projections are formed in the front surface of the rib incorporated in the frame. The pair of projections are coupled with two L-shaped brackets, respectively, and the L-shaped brackets are vertically adjustable with respect to the L-shaped brackets. A key bed and a back rail attached thereto are supported by the L-shaped brackets. Namely, holes are formed in the key bed as well as in the back rail, and bolts are screwed through the holes into the L-shaped brackets.

An upright piano is transformable into an automatic player piano, and electro-magnetic actuators are incorporated into the upright piano. The electro-magnetic actuators are selectively energized, and drives the associated hammers for striking the strings. The electro-magnetic actuators are usually provided in the space between the key bed and the plate, and a narrow key bed is used for the upright piano transformable into the automatic player piano.

The prior art coupling members or the L-shaped brackets disclosed in the Japanese Utility Model Publication can vertically regulate the interrelation between the key bed and the projections. However, if a key bed has been unintentionally warped in the fore-and-aft direction, the L-shaped brackets do not render a key board on the key bed horizontal. Namely, even if the L-shaped brackets horizontally keep the rear edge of the key bed horizontal, the key bed is gradually sloped due to the warping, and the keyboard on the key bed is hardly kept horizontal. If the upright piano is equipped with the narrow key bed, the width of the narrow key bed sets limit on solution of the problem.

SUMMARY OF THE INVENTION

It is therefore an important object of the present invention to provide an upright piano which is equipped with coupling members between a key bed and a frame for horizontarizing a keyboard.

To accomplish the object, the present invention proposes to regulate the horizontality of a key bed with a wedged member interposed between a bracket and the key bed or between a frame and a bracket.

In accordance with the present invention, there is provided an upright piano comprising a) a frame upright with respect to a floor, and having projections horizontally projected, b) a key bed assembly supported by the frame, and allowing a keyboard to be mounted thereon, c) bracket members provided between the projections and the key bed assembly for coupling the key bed assembly with the frame, and d) wedged members coupled between the projections and the bracket members or between the bracket members and the key bed assembly for regulating the horizontality of the keyboard.

BRIEF DESCRIPTION OF THE DRAWINGS

The features and advantages of the upright piano according to the present invention will be more clearly understood from the following description taken in conjunction with the accompanying drawings in which.

DESCRIPTION OF THE PREFERRED EMBODIMENTS

First Embodiment

Figure 1:
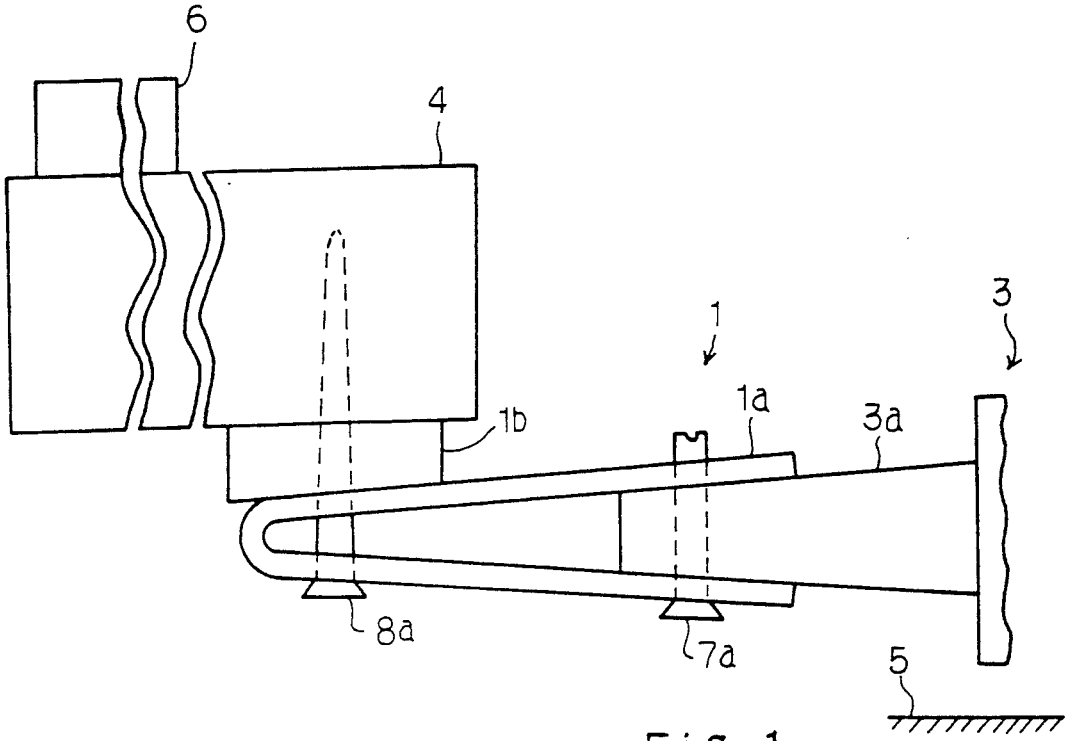
FIG. 1 is a side view showing the structure of a coupling unit incorporated in an upright piano according to the present invention.
Figure 2:
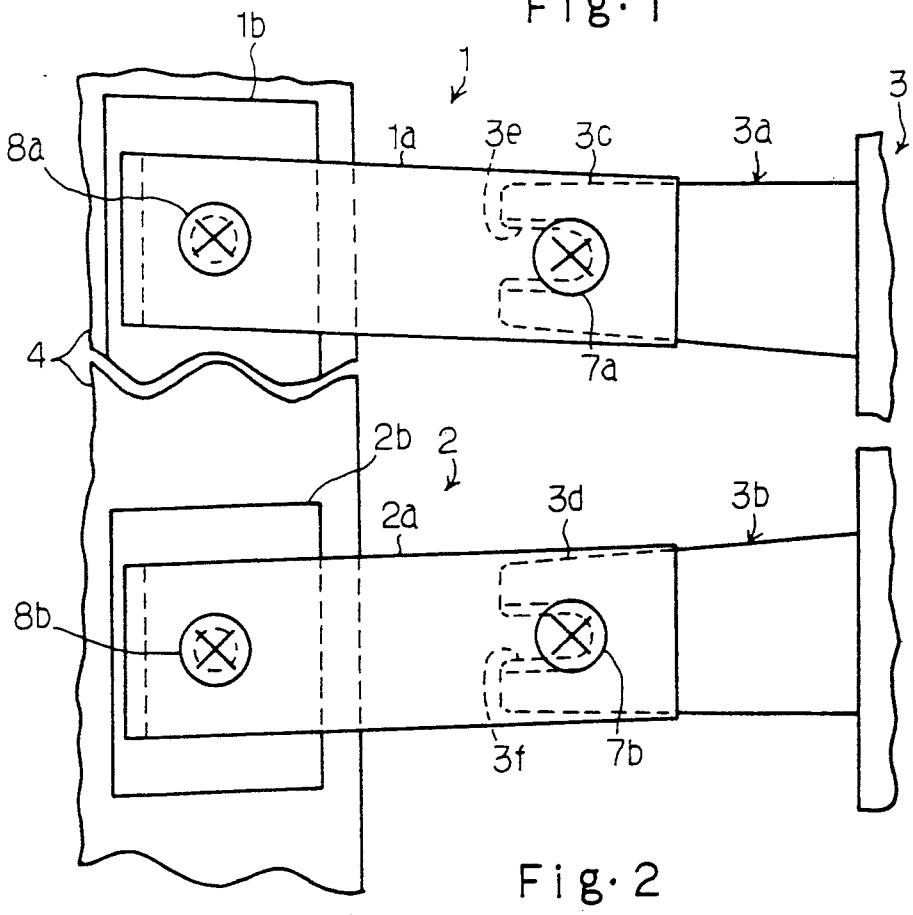
FIG. 2 is a bottom view showing the coupling unit shown in FIG. 1.

Referring to FIGS. 1 and 2 of the drawings, coupling units 1 and 2 incorporated in an upright piano embodying the present invention are associated with projections 3*a* and 3*b* of a frame 3, and are provided between the projections 3*a* and 3*b* and a key bed assembly 4. The frame 3 is substantially upright with respect to a floor 5 where the upright piano is placed, and the projections 3*a* and 3*b* are horizontally projected from the frame 3. A keyboard 6 implemented by white and black keys is mounted on an upper surface of the key bed assembly 4, and the key bed is relatively narrow so as to allow electro-magnetic actuators to be installed. Although the key bed assembly 4 is fabricated from a key bed and rails, these component members are not shown in detail in the drawings for the sake of simplicity. The frame 3 is constructed from a plate member, a plate base, a sound board, a sound board base and ribs as similar to that of the prior art upright piano. However, the frame 3 as a whole is represented by two broken blocks with the projections 3*a* and 3*b* also for the sake of simplicity.

As will be better seen from FIG. 2, the projection 3*a* and 3*b* have respective bifurcated leading end portions 3*c* and 3*d*, and grooves 3*e* and 3*f* are, accordingly, formed in the bifurcated leading end portions 3*c* and 3*d*, respectively.

On the other hand, the coupling units 1 and 2 comprises bracket members 1*a* and 2*a*, and wedged members 1*b* and 2*b*. Each of the brackets 1*a* and 2*a* is turned back at the mid portion thereof, and has an upper strip and a lower strip merged into the turn-back mid portion. Two holes passes through the upper and lower strips of each bracket 1*a* or 2*a*, and are spaced apart from each other by a predetermined distance. Each of the projections 3*a* and 3*b* is inserted between the upper and lower strips of the associated bracket 1*a* or 2*a*, and a bolt 7*a* or 7*b* is screwed through the groove 3*e* or 3*f* into one of the holes, and the bracket 1*a* or 2*a* is fixed to the associated projection 3*a* or 3*b*.

The wedge members 1*b* and 2*b* are shaped into a column of a trapezoid, and the column has a front surface and a back surface in parallel to each other. The upper surface of the column is substantially perpendicular to the front and back surfaces, and the lower surface forms a slope between the front and back surfaces. In other words, the thickness of the column is decreased from the front surface to the back surface. The wedge members 1*b* and 2*b* have respective through holes, and bolts 8*a* and 8*b* passes through the other holes of the brackets 1*a* and 2*a* and the through holes of the wedged members 1*b* and 2*b*. The bolts 8*a* and 8*b* are screwed into the key bed assembly 4, and the key bed assembly 4 is supported through the coupling units 1 and 2 by the projections 3*a* and 3*b* of the frame 3.

Since the brackets 1*a* and 2*a* spaces the key bed assembly 4 from the frame 3, a large amount of working space takes place between the key bed assembly 4 and the frame 3, and a worker easily builds up the upright piano according to the present invention. The working space is desirable for installation of electro-magnetic actuators, and the upright piano according to the present invention is transformable into an automatic player piano.

Moreover, even through the key bed is warped in the direction of fore-and-aft direction, the keyboard 6 is held in contact with the key bed assembly 4 along two contact lines, and the appropriately selected wedged members 1*b* and 2*b* allow a virtual surface containing the two contact lines to be in parallel to the floor 5. This results in the keyboard 6 substantially parallel to the floor, and the wedged members 1*b* and 2*b* improve the horizontality of the keyboard 6.

In order to regulate the horizontality of the keyboard 6, various wedged members different in slope may be previously prepared.

Second Embodiment

Figure 3:
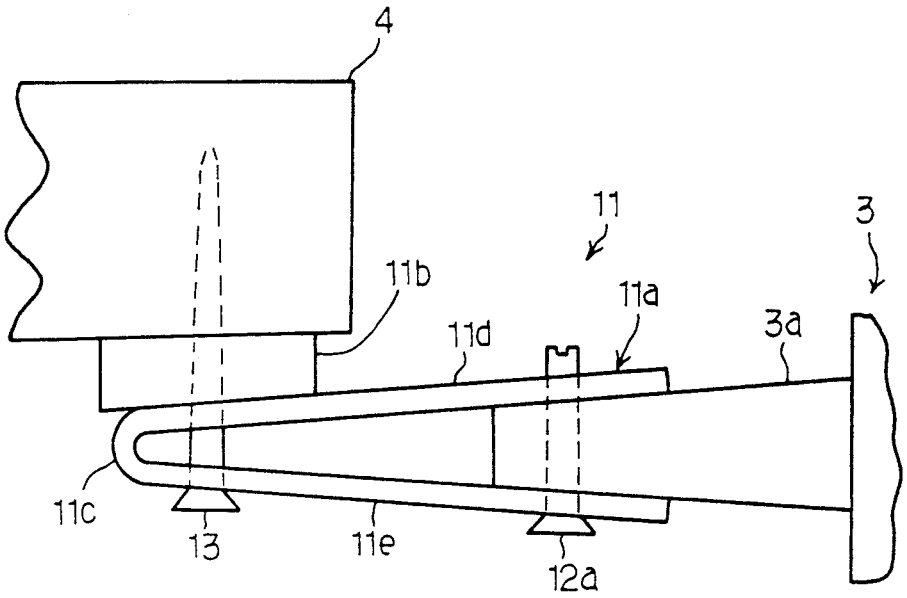
FIG. 3 is a side view showing the structure of a coupling unit incorporated in another upright piano according to the present invention.
Figure 4:
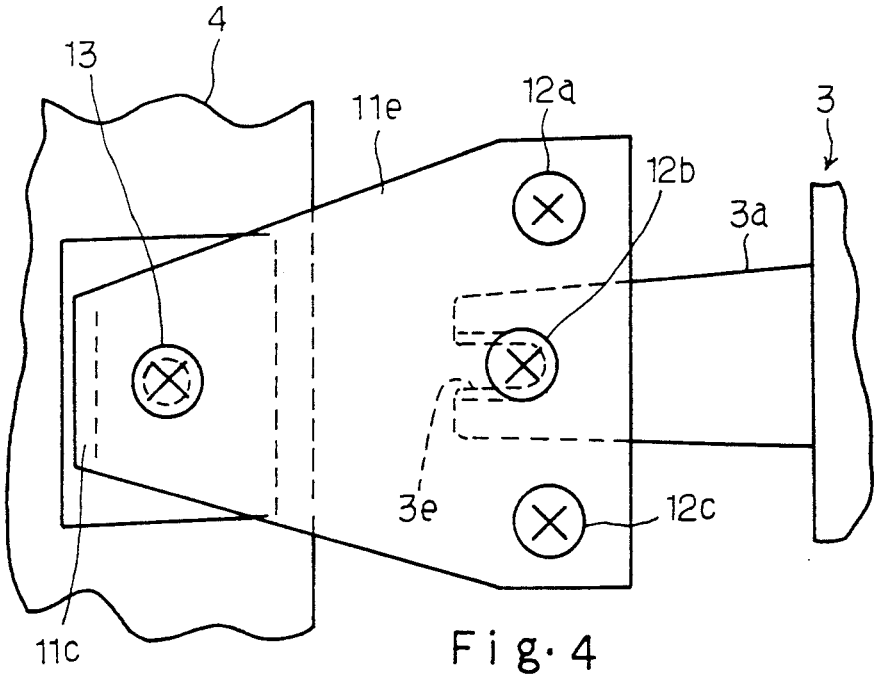
FIG. 4 is a bottom view showing the coupling unit shown in FIG. 3.

Turning to FIGS. 3 and 4 of the drawings, a coupling unit 11 incorporated in another upright piano embodying the present invention is provided between a projection 3*a* of a frame 3 and a key bed assembly 4. The coupling unit 11 comprises a bracket member 11*a* and a wedged member 11*b*, and the bracket member 11*a* is screwed at one end portion thereof into the projection 3*a* by means of three bolts 12*a*, 12*b* and 12*c*. Namely, the bracket member 11*a* has a turn-back portion 11*c*, an upper plate portion 11*d* merged into the turn-back portion 11*c* and a lower plate portion 11*e* also merged into the turn-back portion 11*c*. The upper and lower portions 11*d* and 11*e* are shaped into a dovetail configuration, and are, accordingly, increased in width from the turn-back portion to the leading edges thereof. The leading end portions of the upper and lower plate members 11*d* and 11*e* are wider than the projection 3*a*, and the bolts 12*a* and 12*c* causes the upper and lower plate members 11*d* and 11*e* to tightly bind the projection 3*a*. Only the bolt 12*b* passes through the groove 3*e*, and screwed thereto. The bracket member 11*a* is further fixed through the wedged member 11*b* to the key bed assembly 4 by means of a bolt 13, and allows the frame 3 to support the key bed assembly 4. The wedged member 11*b* is similar to the wedged member 1*b*, and no further description is incorporated hereinbelow for avoiding repetition.

All of the advantages of the first embodiment are also achieved by the second embodiment, and the bolts 12*a* and 12*c* further improve the rigid coupling between the projection 3*a* and the bracket member 11*a*. The rigid coupling between the projection 3*a* and the bracket member 11*a* is desirable, because the turn-back portion 11*c* hardly comes down. Since the location of the turn-back portion 11*c* is easily determined by virtue of the bolt members 12*a* and 12*c*, the slope of the wedged member 11*b* is predictable rather than the wedge member 1*b*.

Third Embodiment

Figure 5:
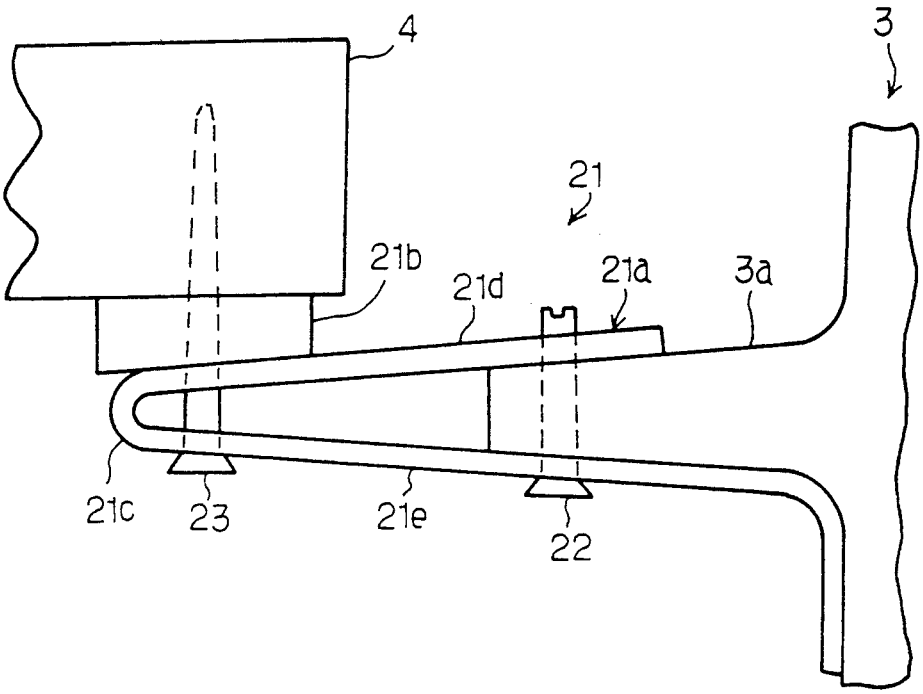
FIG. 5 is a side view showing the structure of a coupling unit incorporated in yet another upright piano according to the present invention.
Figure 6:
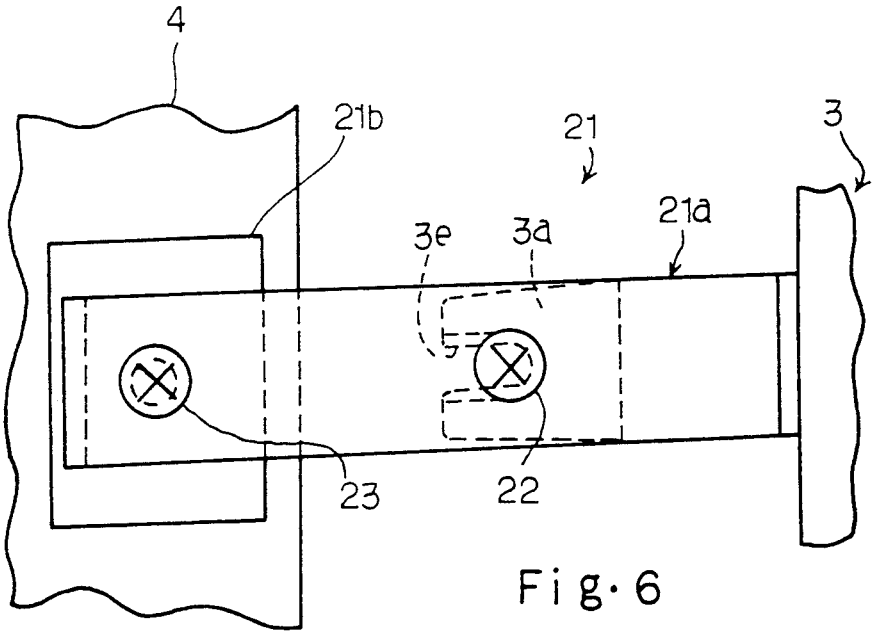
FIG. 6 is a bottom view showing the coupling unit shown in FIG. 5.

Turning to FIGS. 5 and 6 of the drawings, a coupling unit 21 incorporated in yet another upright piano embodying the present invention is provided between a projection 3*a* of a frame 3 and a key bed assembly 4. The coupling unit 21 also comprises a bracket member 21*a* and a wedged member 21*b*, and the wedged member 21*b* is similar to the wedged member 1*b*. A bolt 22 fixes the bracket member 21*a* to the projection 3*a*, and a bolt 23 secures the bracket member 21*a*, the wedged member 21*b* and the key bed assembly 4. The bracket member 21*a* has a turn-back portion 21*c*, an upper strip portion 21*d* merged into the turn-back portion 21*c* and a lower strip portion 21*e* also merged into the turn-back portion 21*c*. The lower strip portion 21*e* is projected from the turn-back portion 21*c*, and is downwardly curved along the frame 3. The leading end sub-portion of the lower strip portion 21*e* is brought into the lower surface of the projection 3*a* and a vertical surface of the frame 3, and allows the frame 3 to fixedly support the bracket member 21*a*. Thus, the curved leading end sub-portion fixes the interrelation between the frame 3 and the bracket member 21*a*, and the turn-back portion 21*c* hardly comes down. For this reason, the location of the turn-back portion 21*c* is easily determined, and the slope of the wedged member 21*b* is predictable as similar to that of the second embodiment. All of the advantages of the first embodiment are also achieved by the third embodiment.

Fourth Embodiment

Figure 7:
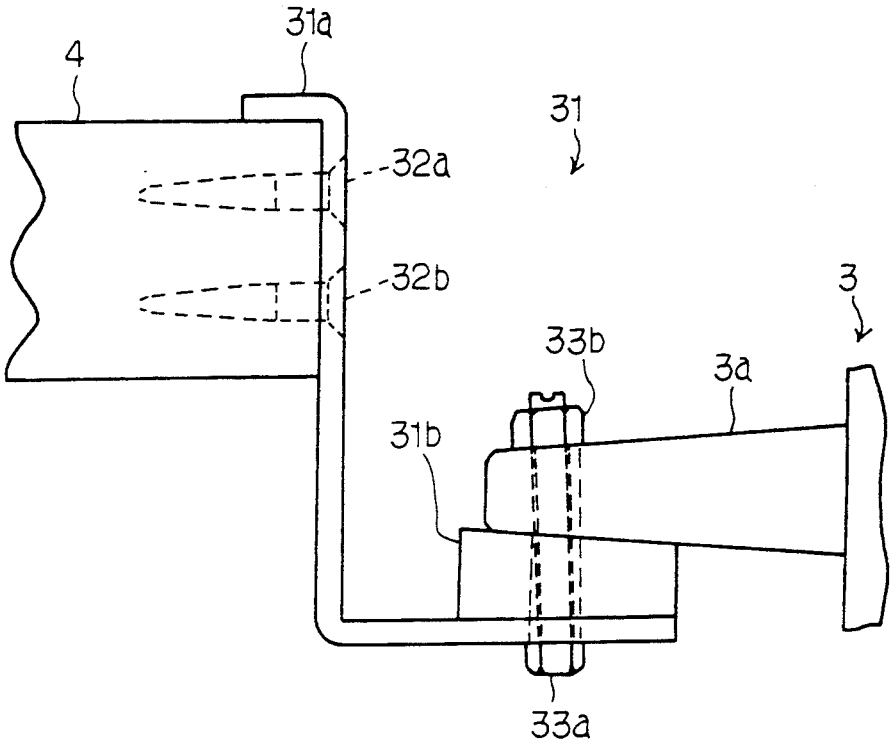
FIG. 7 is a side view showing the structure of a coupling unit incorporated in yet another upright piano according to the present invention.
Figure 8:
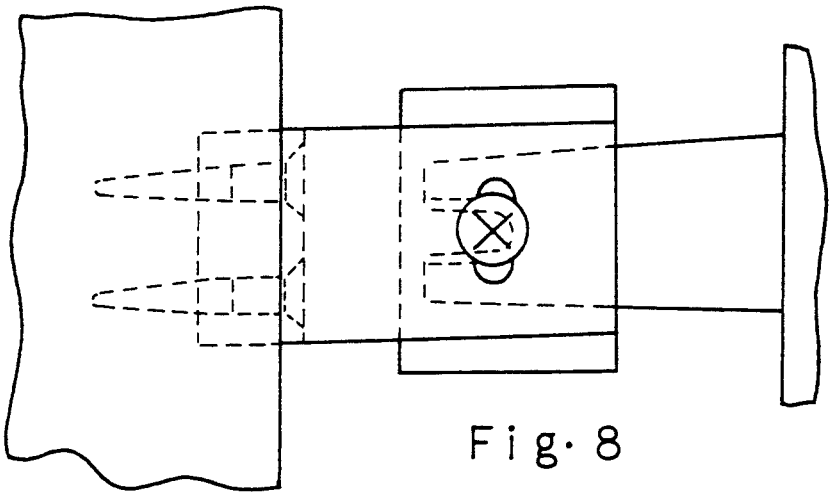
FIG. 8 is a bottom view showing the coupling unit shown in FIG. 7.

Turning to FIGS. 7 and 8, a coupling unit 31 incorporated in yet another upright piano embodying the present invention is provided between a projection 3*a* of a frame 3 and a key bed assembly 4. The coupling unit 31 comprises a generally L-shaped bracket member 31*a* and a wedged member 31*b*, and the wedged member 31*b* has a front surface closer to a player, a back surface parallel to the front surface, a lower surface substantially perpendicular to the front and back surfaces and an upper surface sloped from the front surface to the back surface. The slope of the upper surface decreases the thickness of the wedged member 31*b* from the front surface to the back surface. The generally L-shaped bracket member 31*a* is secured to the back surface of the key bed assembly 4 by means of bolts 32*a* and 32*b*, and is further secured through the wedged member 31*b* to the projection 3*a* by means of a bolt 33*a* and a nut 33*b*. The bolts 32*a* and 32*a* are screwed into appropriate areas of the back surface of the key bed assembly 4, and the interrelation between the bolts 32*a* and 32*b* and the appropriate areas is adjustable by selecting the thickness of the wedged member 31*b*. All of the advantages of the first embodiment are also achieved by the fourth embodiment. Since the bolt 33*a*passes through a single plate of the generally L-shaped bracket member 31*a*, the assembling work is easy for a worker.

Although particular embodiments of the present invention have been shown and described, it will be obvious to those skilled in the art that various changes and modifications may be made without departing from the spirit and scope of the present invention.

What is claimed is:

1. An upright piano comprising a) a frame upright with respect to a floor, and having projections horizontally projected.

b) a key bed assembly supported by said frame, and allowing a keyboard to be mounted thereon, c) bracket members provided between said projections and said key bed assembly for coupling said key bed assembly with said frame, and d) wedged members coupled between said projections and said bracket members or between said bracket members and said key bed assembly for regulating horizontality of said keyboard.

2. An upright piano as set forth in claim 1, in which each of said bracket members has a turn-back portion and upper and lower strips projecting from the turn-back portion for sandwiching said associated projection therebetween, said upper and lower strips being fixed to said associated projection.

3. An upright piano as set forth in claim 2, in which said upper and lower strips are substantially constant in width, said upper and lower strips being fixed to said associated projection by means of a single bolt.

4. An upright piano as set forth in claim 2, in which said upper and lower strips are increased in width from the turn-back portion so that leading end sub-portions of said upper and lower strips are wider than said associated projection, a first bolt passes through said lower strip, a groove formed in said associated projection and said upper strip, second and third bolts pass through said upper and lower strips so as to allow said upper and lower strips to tightly bind said associated projection.

5. An upright piano as set forth in claim 2, in which said lower strip has a straight sub-portion projected from said turn-back portion and a leading end sub-portion curved from said straight sub-portion, said straight sub-portion being held in contact with a lower surface of said associated projection, said leading end sub-portion being held in contact with a vertical surface of said frame from which said projections extend.

6. An upright piano as set forth in claim 1, in which each of said wedged members is generally shaped into a column of a trapezoid having a front surface closer to a player, a back surface parallel to said front surface, an upper surface perpendicular to said upper and lower surfaces and held in contact with a lower surface of said key bed assembly, and a lower surface sloped from said front surface to said back surface, said bracket member, said wedged member and said key bed assembly being fixed by means of a bolt.

7. An upright piano as set forth in claim 1, in which each bracket member has a generally L-shaped configuration having a vertical plate and a horizontal plate, said vertical plate being bolted to a back surface of said key bed assembly, said horizontal plate being fixed through said wedged member to a lower surface of said associated projection.

8. An upright piano as set forth in claim 7, in which said wedged member has a front surface, a back surface parallel to said front surface, a lower surface fixed to an upper surface of said horizontal plate, and an upper sloped surface fixed to the lower surface of said associated projection.

* * * * *